US005280664A

United States Patent [19]

Lin

[11] Patent Number: 5,280,664

[45] Date of Patent: Jan. 25, 1994

[54] DISPOSABLE HOUSEHOLD CLEANING DEVICES

[76] Inventor: Mary D. Lin, 807 S. Bishop, Chicago, Ill. 60607-4021

[21] Appl. No.: 855,992

[22] Filed: Mar. 20, 1992

[51] Int. Cl.[5] ..... A47L 13/10; A47L 13/44

[52] U.S. Cl. ..... 15/247; 15/104.002; 15/227

[58] Field of Search ..... 15/227, 247, 104.002

[56] References Cited

U.S. PATENT DOCUMENTS

| | | | |
|---|---|---|---|
| 1,114,163 | 10/1914 | Mansfield | 15/247 |
| 2,239,919 | 4/1941 | Lindfelt | 15/227 |
| 2,249,559 | 7/1941 | Hilty | 15/247 |
| 2,301,586 | 11/1942 | Rubin | 15/247 |
| 2,394,855 | 2/1946 | Gould | 15/104.002 |
| 2,821,731 | 2/1958 | May | 15/227 |
| 3,056,154 | 10/1962 | Neal | 15/104.002 |
| 3,103,029 | 9/1963 | Valles | 15/104.002 |
| 3,400,420 | 9/1968 | Granville | 15/247 |
| 4,823,427 | 4/1989 | Gibbs | 15/247 |
| 4,945,599 | 8/1990 | Flynn | 15/247 |
| 4,980,943 | 1/1991 | Barber | 15/227 |
| 5,127,127 | 7/1992 | Jarosinski | 15/227 |
| 5,134,746 | 8/1992 | William | 15/227 |

FOREIGN PATENT DOCUMENTS

| | | | |
|---|---|---|---|
| 1252344 | 12/1960 | France | 15/247 |
| 2625 | 2/1911 | United Kingdom | 15/227 |

*Primary Examiner*—Philip R. Coe
*Assistant Examiner*—Randall E. Chin
*Attorney, Agent, or Firm*—Baker & McKenzie

[57] ABSTRACT

The invention relates generally to a disposable household cleaning device and more specifically to disposable dustmop covers and broom covers. The present invention is made of soft, non-abrasive material to insure that the surface being cleaned is not scratched or otherwise harmed during the cleaning process. The present invention also avoids the need to launder dirty dust mop heads. The invention is designed to work in conjunction with commonly used household cleaning devices and employs individually exposable adhesive debris-retaining surfaces which assist in the efficient collection of dust and debris and which allow the invention to be reused several times before disposing of it.

2 Claims, 1 Drawing Sheet

DISPOSABLE HOUSEHOLD CLEANING DEVICES

BACKGROUND OF THE INVENTION

This invention relates generally to disposable household cleaning devices and more specifically to disposable dust mop covers, broom covers, and dusting mitts.

Over the past several years there has been a resurgence in the popularity of non-carpeted bare floors in the home. Bare floors, which include floors made of hardwood, marble, granite, ceramic, vinyl and other non-carpet surfaces, require different cleaning techniques than carpeted surfaces. Carpeting is most effectively cleaned by vacuum cleaners. However, vacuum cleaners can scratch bare floor surfaces and do not clean bare floors as efficiently as brooms and dust mops.

When one cleans with a broom or dust mop, the dust and debris collected accumulates in the fibers of the broom or on the head of the dust mop until the dust is shaken off or until the head of the dust mop is washed in a washing machine.

Today, because an ever-increasing number of people live in multiple-unit or high-rise housing, many people are unable to go outdoors to shake out their broom or dust mop. In addition, an environmental hazard may be created by shaking out a cleaning device outdoors, which in essence simply dumps the accumulated dust and debris (along with any cleaning product residue) into the environment.

Cleaning a dirty dust mop head in the washing machine creates its own unique inconveniences and difficulties. First, the dust mop head must be washed in a separate load, otherwise, floor dirt and debris would be mixed in with one's clothing. In addition, if any cleaning sprays or polishes were used on the mop head, a chemical residue will be left in one's washing machine.

When cleaning a floor with a broom, one must continually bend over to sweep the accumulated dust and debris into a dust pan. Also, when using a broom with a dust pan, some dust and debris invariably remains on the surface of the floor. Finally, brooms, dust mops and dust cloths are simply unable to fully collect certain types of debris, such as hair.

The present invention is designed to eliminate the problems noted above, as well as to allow for more efficient and effective cleaning than by traditional means.

Specifically, a disposable cleaning cover, which can be fitted over a dust mop or broom much like a pillowcase is fitted around a pillow, or worn like a glove, allow for the easy cleaning of floors or other household surfaces. The covers include individually employable debris-retaining surfaces (such as a series of removable adhesive strips) surrounded by soft, non-abrasive material to insure that the surface being cleaned will not be scratched or damaged. Each debris-retaining surface may be used several times before it needs to be replaced. Because each cover includes a series of individually employable debris-retaining surfaces, a given cover may be used numerous times before it needs to be disposed.

The present invention also obviates the need for buying additional bulky and expensive cleaning devices because the disposable covers are specifically designed to easily fit over standard sized brooms or dust mops or to be worn on one's hand like a glove. And, as noted above, the present invention makes the use of a dust pan unnecessary.

The entire cover and debris-retaining surface can be made of easily recyclable paper and other fiber-based materials so that although the product is "disposable", it may be disposed of in an environmentally prudent manner by simply recycling the product along with one's newspapers.

SUMMARY OF THE INVENTION

An important object of the present invention is to provide a device for cleaning bare floors and other household surfaces which is easily disposable.

A further object of the present invention is to provide a device which cleans bare floors and other household surfaces more effectively than conventional brooms, dust mops or vacuum cleaners.

A further object of the present invention is to provide a cleaning device which attracts and retains dust and debris so that the device need not be laundered or shaken out.

A further object of the present invention is to provide a cleaning device which attracts and retains dust and debris so that the dust and debris is disposed of with the cover.

A further object of the present invention is to provide a cleaning device which will not scratch or otherwise harm bare floors or other household surfaces.

A further object of the present invention is to provide a cleaning device which can be used in conjunction with other commonly used household cleaning devices.

A further object of the present invention is to provide a disposable cleaning device which may be made of easily recyclable materials.

BRIEF DESCRIPTION OF THE DRAWINGS

The invention is illustrated more or less diagrammatically in the drawings, wherein.

DETAILED DESCRIPTION OF THE INVENTION

Figure 1:
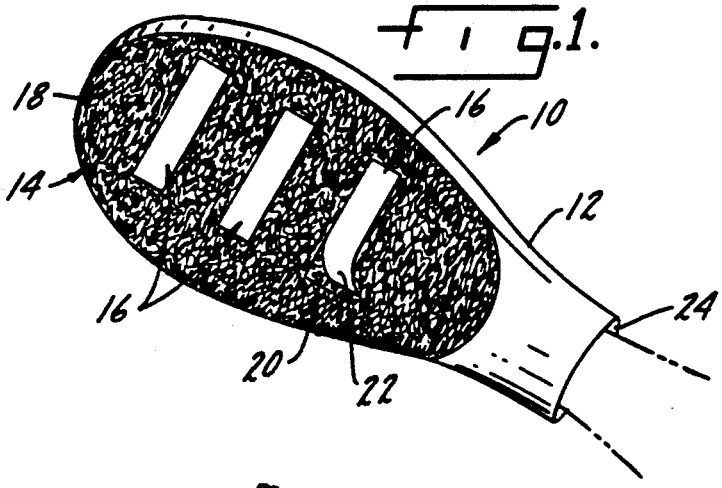
FIG. 1 is a perspective view of a preferred embodiment of the disposable cleaning device of this invention in which the device can be worn over one's hand like a mitt.

Like reference numerals will be used to refer to like or similar parts from Figure to Figure in the drawings, Referring first to FIG. 1, the disposable cleaning device of this invention is indicated generally at 10. It includes a cover portion 12 which may be made of material such as paper toweling reinforced with stronger fibers to prevent tearing. On one side of the cover portion 12 is the dusting means indicated generally at 14, which is comprised of debris-retaining surfaces 16 and a fluffy, soft, non-abrasive area 18. The debris-retaining surfaces 16 may be, for example, a series of adhesive strips 20 with individually removable protective backing 22. Using this design, the user may expose as few or as many of the debris-retaining surfaces as desired, leaving the protective backing on the remaining debris-retaining surfaces for later use. The cover portion 12 also includes an opening 24 into which the user can insert his or her hand so that the cleaning device 10 may be worn over one's hand like a mitt.

Figure 2:
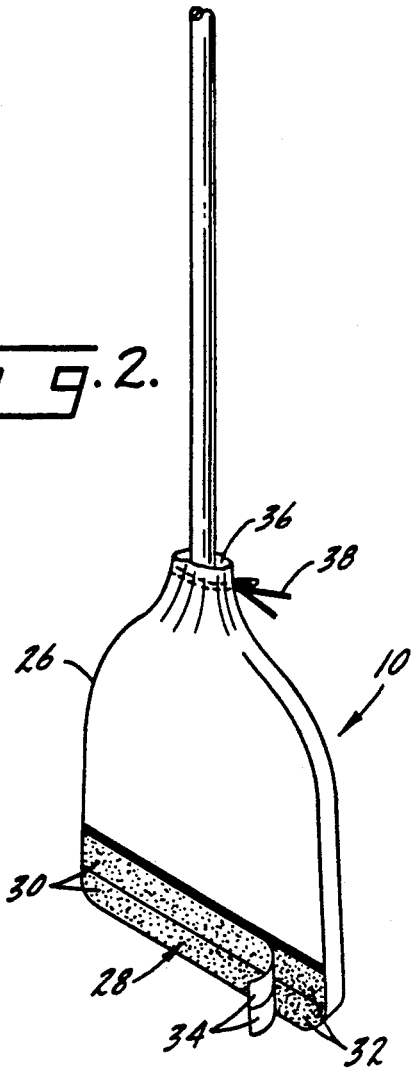
FIG. 2 is a perspective view of another embodiment of the present invention in which the device can be secured around a common household broom.

FIG. 2 discloses another embodiment of the present invention in which the invention is secured around a common household broom. This embodiment is comprised of a cover portion 26, on one side of which are dusting means 28. Debris-retaining surfaces 30, which may be comprised of adhesive strips 32 and protective backings 34, are located along the bottom of the dusting means 28. An opening 36 along the top of the cover portion 26 is located so that the cleaning device 10 may be easily slipped over a broom. Mechanical securing means 38, such as a ribbon, are located just below the opening 36 so that the cleaning device may be securely fastened around the broom after the device has been slipped over the broom head.

Figure 3:
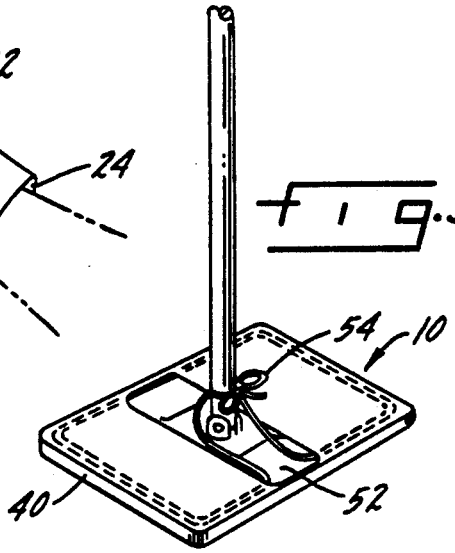
FIG. 3 is a perspective view of another embodiment of the present invention in which the device can be secured around a dust mop.
Figure 4:
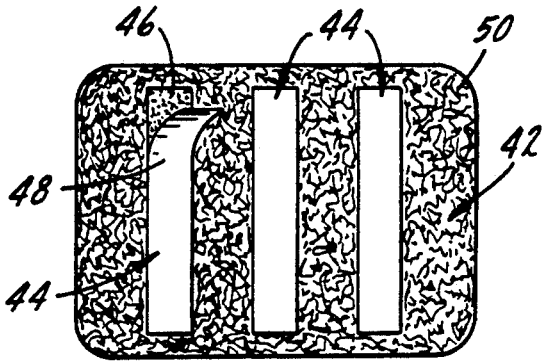
FIG. 4 is a bottom view of the embodiment of FIG. 3.
Figure 5:
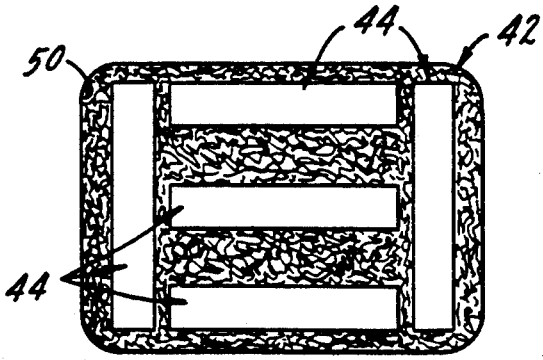
FIG. 5 is a bottom view of an alternate configuration of the embodiment of FIG. 3.

FIGS. 3–5 disclose another embodiment of the present invention by which the invention can be secured around a dust mop. The form of this embodiment shown in FIGS. 3 and 4 is comprised of a cover portion 40, on the bottom side of which is a dusting surface 42. The dusting surface 42 is comprised of a series of debris-retaining surfaces 44, such as those described above which are comprised of, for example, adhesive strips 46 and protective backings 48, and a fluffy, soft, non-abrasive area 50. An opening 52 along the top of the cover portion 40 is located so that the cleaning device 10 may be easily slipped over the head of a dust mop. Mechanical securing means 54, such as a ribbon are located around the opening 52 so that the cleaning device may be securely fastened around the head of the dust mop.

FIG. 5 discloses a variation on the embodiment disclosed by FIGS. 3 and 4 which discloses how the number, nature and position of the debris-retaining surfaces 44 can be varied.

I claim:

1. A disposable cover for the head of any commercially available handle-mounted cleaning device, the cover comprising:

a single opening for inserting the head of the cleaning device;

the single opening being disposed on an upper portion of the cover engaging the head of the cleaning device and securably containing the cleaning device in the cover after placement of the device therein, a dusting surface, the dusting surface including a soft, non-abrasive area for sliding across household surfaces to be dusted, the dusting surface also including a plurality of debris-retaining surfaces interspaced within the soft, non-abrasive area so that portions of the soft, non-abrasive area are disposed between any two debris-retaining surfaces to limit the frictional contact between the debris-retaining surfaces and the household surface to be dusted, each debris-retaining surface including an outward-facing adhesive strip for attracting dust and debris, each adhesive strip carrying a removable protective backing to cover the adhesive strip prior to use.

2. A disposable cover for the head of a commercially-available handle-mounted cleaning device, the cover comprising:

a single opening for inserting the head of the cleaning device, at least one ribbon disposed adjacent to the single opening securing the cover to the handle of the cleaning device and substantially enclosing the head of the cleaning device within the cover, a dusting surface, the dusting surface including a soft, non-abrasive area for sliding across household surfaces to be dusted, the dusting surface also including a plurality of debris-retaining surfaces interspaced within the soft, non-abrasive area so that portions of the soft, non-abrasive area are disposed between any two debris-retaining surfaces to limit the frictional contact between the debris-retaining surfaces and the household surface to be dusted, each debris-retaining surface including an outward-facing adhesive strip for attracting dust and debris, each adhesive strip carrying a removable protective backing to cover the adhesive strip prior to use.

* * * * *